US005139441A

United States Patent [19]

Jonval

[11] Patent Number: 5,139,441

[45] Date of Patent: Aug. 18, 1992

[54] ELECTRICAL DEVICE WITH CAPTIVE EXTERNAL CABLE CLAMP

[75] Inventor: Pierre Jonval, Nogent-sur-Marne, France

[73] Assignee: Legrand, Limoges, France

[21] Appl. No.: 592,322

[22] Filed: Oct. 3, 1990

[30] Foreign Application Priority Data

Oct. 5, 1989 [FR] France ..... 89-13023

[51] Int. Cl.[5] ..... H01R 13/59

[52] U.S. Cl. ..... 439/472; 439/470

[58] Field of Search ..... 439/465, 467, 469, 470, 439/472

[56] References Cited

U.S. PATENT DOCUMENTS 2,186,751 1/1940 Chirelstein ..... 439/472
3,148,928 9/1964 Noschese et al. ..... 439/467
4,900,277 2/1990 Inaba et al. ..... 439/465 X

FOREIGN PATENT DOCUMENTS 3524384 1/1987 Fed. Rep. of Germany ..... 439/467
1333606 6/1963 France .
2173455 10/1973 France .
2624664 6/1989 France .
1418135 12/1975 United Kingdom .

*Primary Examiner*—Eugene F. Desmond
*Attorney, Agent, or Firm*—Longacre & White

[57] ABSTRACT

An electrical device, for example an industrial cable-mounted connector, comprises a cover including a cable outlet and an associated cable clamp for retaining a cable. The cable clamp comprises two jaws adapted to be clamped together. The jaws are separate from the cover. They are permanently attached to its exterior.

14 Claims, 2 Drawing Sheets

ELECTRICAL DEVICE WITH CAPTIVE EXTERNAL CABLE CLAMP

BACKGROUND OF THE INVENTION

1. Field of the Invention

The present invention is generally concerned with electrical devices of the kind including a cover incorporating a cable outlet with an associated cable clamp for retaining the cable.

It is directed more particularly, but not necessarily exclusively, to cable-mounted connectors, especially industrial cable-mounted connectors.

2. Description of the Prior Art

For safety reasons it is desirable if the cable clamp of electrical devices in the form of industrial cable-mounted connectors (plug and/or socket) cannot be lost.

The personnel responsible for attaching these devices to a cable necessarily have to hand the cable clamp which, once properly clamped onto the cable, prevents any subsequent traction applied to the cable detaching any conductors from the mechanism, in this instance a contact assembly, to which it has been connected.

At present the cable clamp usually comprises two jaws to be clamped together and is usually contained within the cover.

This is the case, for example, in French patent 2 173 455.

In this French patent the jaws of the cable clamp are in one piece with the insulative material support of the mechanism.

Although this arrangement is satisfactory, it has the disadvantage of taking up significant space within the cover.

Although it acceptable for straight cable-mounted connectors, it is not necessarily acceptable for cranked connectors, all the more so in that this arrangement is then difficult to reconcile with the requirement for a particular angular orientation of the mechanism relative to the cover according to the maximum load voltage to be complied with.

In German utility model No 66 04 978 the cable clamp is also inside the cover and uses screws which pass through the latter.

Apart from the fact that these screws are difficult to insert blind, the fact that they pass through the cover compromises the seal.

What is more, if the cable clamp is not correctly tightened in either case this deficiency is not visible.

In French patent No 1 333 606 the cover comprises two pivoting half-covers and the ends of the half-covers form the jaws of a cable clamp.

Insufficient tightening of the cable clamp may then be visible, but the fact that the cover is made as two half-covers means that it cannot provide a seal.

A general object of the present invention is an arrangement which advantageously meets the requirement for a captive cable clamp while avoiding the disadvantages outlined above, with additional advantages.

SUMMARY OF THE INVENTION

The present invention consists in a electrical device comprising a cover including a cable outlet and an associated cable clamp for retaining a cable, said cable clamp comprising two jaws adapted to be clamped together and separate from said cover, to the exterior of which they are permanently attached.

Both jaws are articulated to the cover, for example.

Fixed to the cover, they cannot be lost, so meeting the stated requirement.

They do not compromise the sealing action of the cover and the cover can advantageously be in one piece, in the usual way.

The external configuration (straight or angled) of the cover and its internal layout are of no consequence with respect to the cable clamp jaws.

Finally, being external to the cover any deficiency in their use, and in particular any insufficient tightening of the cable clamp that they form, is normally immediately apparent.

The characteristics and advantages of the invention will emerge from the following description given by way of non-limiting example only with reference to the appended diagrammatic drawings.

DETAILED DESCRIPTION OF THE INVENTION

Figure 1:
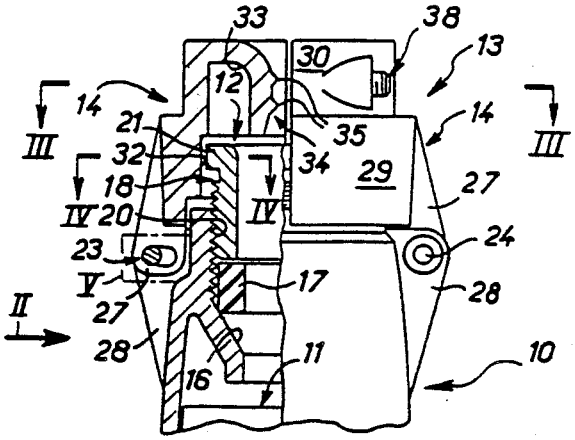
FIG. 1 is a partial view, partly in elevation and partly in axial cross-section, of an electrical device in accordance with the invention showing the cable clamp that it incorporates in the closed or clamped configuration.
Figure 2:
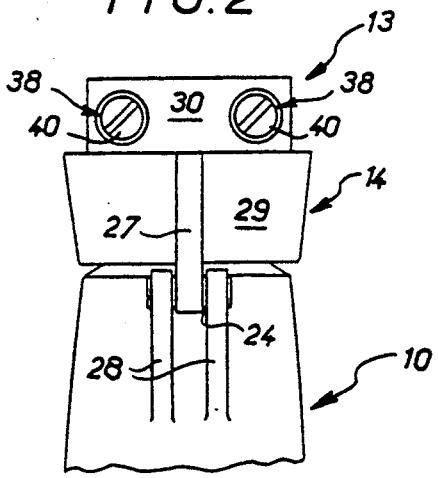
FIG. 2 is a partial side view of this electrical device as seen in the direction of the arrow II in FIG. 1.
Figure 3:
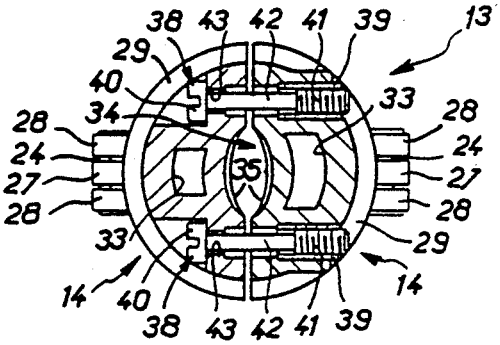
FIG. 3 is a view of it in transverse cross-section on the line III—III in FIG. 1.
Figure 4:
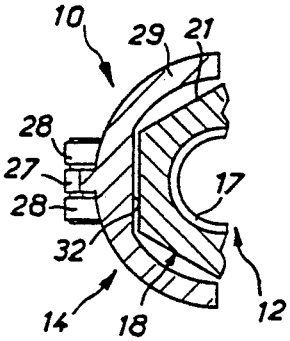
FIG. 4 is another partial view of it in transverse cross-section on the line IV—IV in FIG. 1.
Figure 5:
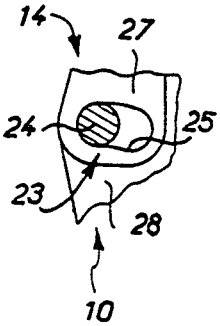
FIG. 5 shows to a larger scale the detail of FIG. 1 marked by the box V.

The figures show, by way of example only, the application of the invention to an industrial cable-mounted connector, to be more precise a plug for a cable-mounted connector of this kind, of the type which is the subject matter of French patent No 72 06420 and German utility model No 66 04 978 mentioned above, for example.

A plug of this kind being well known in itself and not of itself forming any part of the present invention, it will not be described in detail here.

Suffice to say that it comprises under a cover 10 any form of mechanism 11, that is to say any form of contact assembly, whether the contacts are male (pins) or female (receptacles). The cover 10 is in one piece and has at the end opposite the mechanism 11 a cable outlet 12 to be described in more detail later. Associated with the cable outlet 12 is a cable clamp 13 adapted to retain the cable and comprising to this end two jaws 14 adapted to be clamped together.

In the embodiment shown in FIGS. 1 through 6 the cable outlet 12 is a cable gland.

It therefore comprises, in a known way, an annular packing 17 of compressible material in contact with a frustoconical bearing surface 16 of the cover 10. The annular packing 17 is compressed onto the frustoconical bearing surface 16 by an annular clamping member 18 or cap in screwthreaded engagement with a cylindrical bearing surface 20 on the cover 10. It is turned by a hexagonal flange 21 at its free end.

According to the invention, the jaws 14 of the cable clamp 13 are separate from the cover 10, being fixed permanently to its exterior.

At least one of the jaws 14 is preferably articulated to the cover 10.

In all the embodiments shown here both jaws 14 are pivoted to the cover 10.

The articulation 23 by which a jaw 14 is pivoted to the cover 10 is preferably an articulation with clearance to enable the jaw 14 to move away from the cover 10, to be more precise from the axis of the cover 10.

In all the embodiments shown here the articulation 23 with clearance comprises a pin 24 perpendicular to the axis of the cover 10 passing through a slot 25 in an axial plane of the cover 10.

In the embodiments shown in FIGS. 1 through 7 each jaw 14 is carried by an arm 27 incorporating the corresponding slot 25 and the pin 24 extends between two lugs 28 in one piece with the cover, enclosing the arm 27 in the manner of a yoke.

The slot 25 is slightly curved in practise, along an axis on the side of the cover 10 opposite the cable outlet 12.

Each jaw 14 is substantially semicircular and symmetrical relative to the arm 27 carrying it.

In its lower part it has a base 29 from which the arm 27 carrying it extends and which is adapted to align with the flange 21 on the annular clamping member 18 of the cable gland constituting the cable outlet 12.

In its upper part it has a superstructure 30 whereby it circumvents axially the annular clamping member 18 to come close to the axis of the cover 10. The interior of the base 29 of at least one of the jaws 14 (both of them in practise) incorporates a flat 32 adapted to prevent rotation of the annular clamping member 18 of the cable gland constituting the cable outlet 12 through cooperation with one of the flats on the flange 21, possibly with some clearance.

In all the embodiments shown here the superstructure 30 of at least one of the jaws 14 (both of them in practise) is reduced in weight by means of a blind hole 33 in its interior.

The inside of the superstructure 30 forms a cradle 34 with at least one transverse projecting rib 35 which comes into contact with the cable to be clamped.

Here two spaced ribs 35 are provided.

Clamping means link the jaws 14.

The clamping means are formed by two parallel screws 38 at respective ends of the jaws 14 beyond the cradle 34. Both are carried by one jaw 14 and cooperate with screw threaded lugs 39 on the other.

Each screw 38 includes between the head 40 and a screwthreaded end 41 adapted to cooperate with the screw threaded lug 39 a smaller diameter smooth machined part 42.

Fitted by forcing their screwthreaded end 41 through holes 43 provided to this end in the jaw 14 which carries them, or by causing them to cut their own thread through the holes 43, the screws 38 are advantageously captive.

The screwthreaded lugs 39 contain metal inserts.

Figure 6:
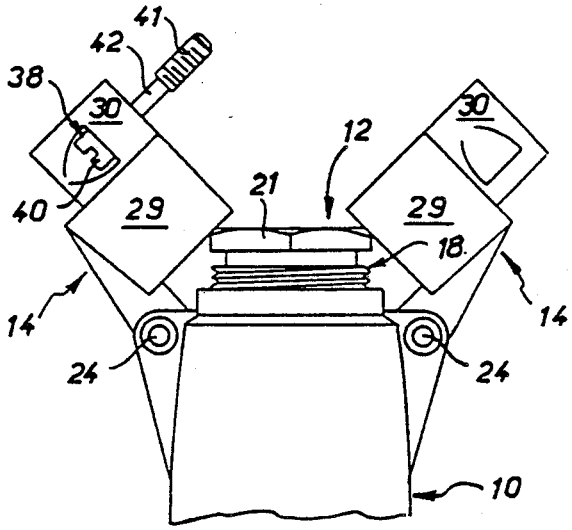
FIG. 6 is a partial elevation view of the electrical device in accordance with the invention showing the cable clamp that it incorporates in the open or unclamped configuration.

To use the cable clamp 13 in accordance with the invention the jaws 14 are first moved apart as shown in FIG. 6 to enable the cable to be connected to the mechanism 11 to be inserted through the cable outlet 12.

After the cable has been connected to the mechanism 11 and the latter has been drawn into the cover 10, all that is needed is to clamp the two jaws 14 of the cable clamp 13 to the cable using the screws 38 provided for this purpose.

Figure 7:
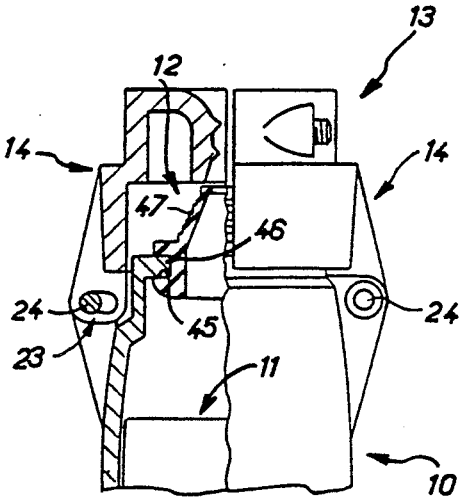
FIG. 7 is a partial view, partly in elevation and partly in axial cross-section, analogous to that of FIG. 1, for a second embodiment of the electrical device in accordance with the invention.

In the embodiment shown in FIG. 7 the cable outlet 12 is an elastic material grommet having at its base a groove 45 by means of which it is attached to a radial flange 46 provided for this purpose at the end of the cover 10. It has a stepped frustoconical wall 47 by virtue of which it is adapted to grip the cable connected to the mechanism 11 in a sealed way.

As grommets of this kind are well known in themselves they will not be described in more detail here.

The other arrangements are exactly the same as those previously described, in particular with regard to the cable clamp 13.

Figure 8:
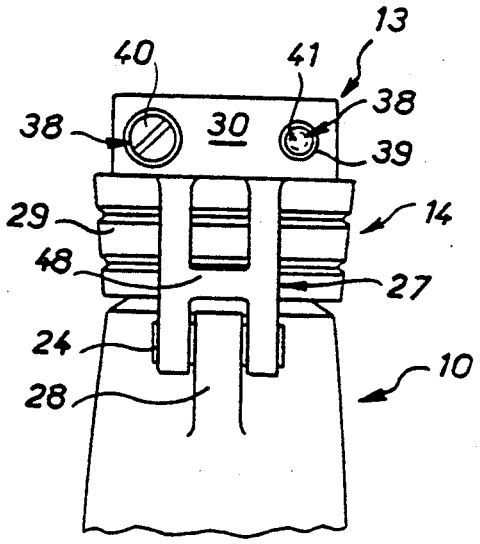
FIGS. 8, 9 and 10 are views respectively analogous to those of FIGS. 2, 3 and 4, for a third embodiment of this electrical device.
Figure 9:
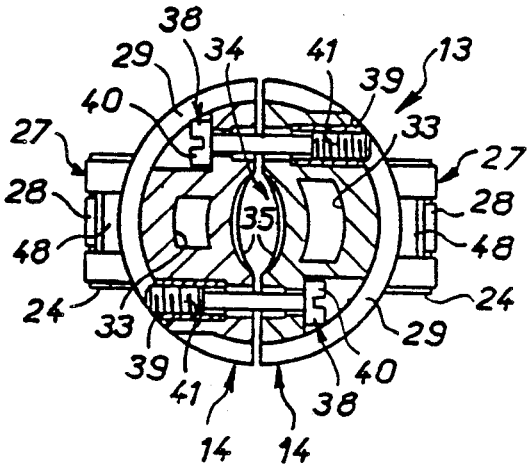
Figure 10:
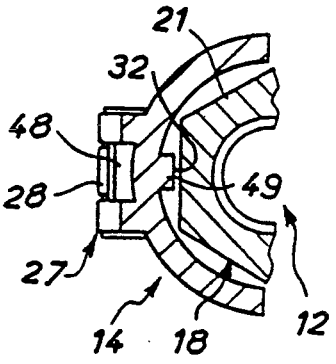

In the embodiment shown in FIGS. 8 through 10 the arm 27 on the jaw 14 is yoke-shape and the cover 10 carries a single lug 28.

The two flanges forming the arm 27 are joined by a crossmember 48.

In this embodiment the flat 32 inside each jaw is formed by the edge of a rib 49.

The screws 38 are arranged head-to-tail, with the head 40 of one screw on one of the jaws 14 and that of the other screw on the other jaw 14.

Of course, the present invention is not limited to the embodiments described and shown but encompasses any variant execution thereof.

In particular, the two jaws of the cable clamp in accordance with the invention may be identical, each having a screw at one side and a screwthreaded lug at the other side.

Also, the field of application of the invention is not limited to connectors, a plug for which has been specifically described and shown, but encompasses all electrical devices to which a cable is attatched.

There is claimed:

1. Electrical device comprising a cover having a longitudinal axis and including a cable outlet and an associated cable clamp for clamping a cable therein, said cable clamp comprising two jaws separate from said cover and adapted to be clamped together, said jaws being permanently attached to said cover, an articulation means for pivotally jointing at least one of said cable clamp jaws to said cover with clearance and adapted for adjustment of position of said at least one jaw transversely relative to the longitudinal axis of the cover.

2. Device according to claim 1, wherein, said articulation means is located in lugs projecting from said cover.

3. Device according to claim 1, wherein both cable clamp jaws are articulated to said cover.

4. Device according to claim 1, wherein the articulation of each cable clamp jaw to said cover is an articulation with clearance.

5. Device according to claim 1, wherein each of said jaws has an articulation generally perpendicular to the longitudinal axis of the cover, said articulations also permanently attaching the jaws to said cover.

6. Device according to claim 5, wherein said jaws provide full access to said cable outlet when they are swung to a position away from each other.

7. Device according to claim 5, wherein each of said jaws comprises an integral arm cooperating with the respective articulation, said arms having a general plane parallel to the longitudinal axis.

8. Device according to claim 5, wherein said jaws are disposed substantially entirely beyond a front end of said cover when said jaws are in facing relationship.

9. Device according to claim 1, further comprising at least one screw for securing said jaws together, said jaws are adapted to be swung away from each other when the screw is out of engagement with one of the jaws.

10. Device according to claim 9, wherein said screw extends in a direction generally perpendicular to said articulation when said jaws are in facing relationship.

11. Electrical device comprising a cover having a longitudinal axis, said cover including a cable outlet and an associated cable clamp for retaining a cable, said cable clamp comprising two jaws permanently attached to the exterior of said cover, at least one of said jaws having an articulation generally perpendicular to the longitudinal axis of the cover to permit the said one jaw to swing out of direct facing relationship with the other of said jaws, each of said jaws having an articulation generally perpendicular to the longitudinal axis of the cover to permit said jaws to swing away from each other, each of said jaws comprising an integral arm cooperating with the respective articulation, said arms being disposed generally parallel to the longitudinal axis when said jaws are in facing relationship, said cable outlet comprising a cable gland threadedly engaged in said cover, said jaws surrounding a free end of said cable when they are in facing relationship.

12. Electrical device comprising a cover including a cable outlet and an associated cable clamp for retaining a cable, said cable clamp comprising two jaws adapted to be clamped together and separate from said cover, to the exterior of which they are permanently attached, an articulation with clearance articulating at least one of said cable clamp jaws to said cover, said articulation with clearance comprising a pin passing through a slot in an axial plane of said cover.

13. Electrical device comprising a cover including a cable outlet and an associated cable clamp for retaining a cable, said cable clamp comprising two jaws adapted to be clamped together and separate from said cover, to the exterior of which they are permanently attached, an articulation with clearance articulating at least one of said cable clamp jaws to said cover, the articulation of each cable clamp jaw to said cover being an articulation with clearance, said articulation with clearance comprising a pin passing through a slot in an axial plane of said cover.

14. Electrical device comprising a cover including a cable outlet and an associated cable clamp for retaining a cable, said cable clamp comprising two jaws adapted to be clamped together and separate from said cover, to the exterior of which they are permanently attached, said cable outlet being a cable gland incorporating a hexagonal clamping member, and at least one of said cable clamp jaws having on its interior a flat adapted to prevent rotation of said clamping member.

* * * * *